US005215428A

United States Patent [19]

Masini

[11] Patent Number: 5,215,428

[45] Date of Patent: Jun. 1, 1993

[54] APPARATUS FOR THE VERTICAL, AUTOMATIC STACKING OF SHEETS

[75] Inventor: Giancarlo Masini, Galliate, Italy

[73] Assignee: Civiemmes S.r.l., Bogogno, Italy

[21] Appl. No.: 632,340

[22] Filed: Dec. 21, 1990

[30] Foreign Application Priority Data

Dec. 22, 1989 [IT] Italy ..... 22813 A/89

[51] Int. Cl.[5] ..... B65B 27/08

[52] U.S. Cl. ..... 414/789.5; 414/789.6; 414/790; 414/790.8; 414/907

[58] Field of Search ..... 414/788.9, 790.2, 790.3, 414/789.5, 789.6, 792.7, 900, 907, 790.8, 790, 923, 924, 926, 790.1; 271/171, 157, 217, 218, 220

[56] References Cited

U.S. PATENT DOCUMENTS

| | | | |
|---|---|---|---|
| 2,928.559 | 3/1960 | Mosley | 414/789.5 |
| 3,923,145 | 12/1975 | Muller | 414/792.7 X |
| 3,968,886 | 7/1976 | Leon | 414/789.5 |
| 3,969,993 | 7/1976 | Stobb | 414/790.8 |
| 4,037,525 | 7/1977 | Sjogren et al. | 414/790.8 X |
| 4,264,255 | 4/1981 | Saro et al. | 414/790.8 X |
| 4,324,520 | 4/1982 | Kjellberg | 414/789.5 |
| 4,514,128 | 4/1985 | Hedrick | 414/790.8 X |
| 4,541,763 | 9/1985 | Chandhoke et al. | 414/790.8 X |
| 4,554,867 | 11/1985 | Thumm | 414/789.9 X |
| 4,772,169 | 9/1988 | Masini | 414/789.6 |
| 4,880,350 | 11/1989 | Stobb | 414/790.2 |
| 4,897,017 | 1/1990 | Castiglioni | 414/790.8 |

FOREIGN PATENT DOCUMENTS 653378 12/1962 Canada .

*Primary Examiner*—David A. Bucci
*Attorney, Agent, or Firm*—Darby & Darby

[57] ABSTRACT

Apparatus for the vertical and automatic stacking of sheets, as well as for the feeding of cover boards onto the stacks consisting of sheets, with use of a single apparatus for feeding the cover boards, the apparatus for feeding the boards being movable up and down in a vertical plane in an interference stroke within the prestacking stroke, which interference stroke is determined by a lower pushing-in position on the fork of the lower cover board and a pushing-in position of the upper cover board on the finished stack. The stop for the cover boards and the upper end of the side parts of the movable carriage for the stack of sheets are also arranged so as to be movable back and forth in a vertically arranged plane. With the same prestacking strokes, stacks which have a greater stack height are produced, furthermore the efficiency of the stacking apparatus is increased.

3 Claims, 4 Drawing Sheets

APPARATUS FOR THE VERTICAL, AUTOMATIC STACKING OF SHEETS

BACKGROUND OF THE INVENTION

The present invention relates to an apparatus for the automatic, vertical stacking of sheets.

A stacking apparatus of this type has already become known to the applicant from U.S. Pat. No. 4,772,169. In this prior publication, on one side of the compartment for forming the stack, to be more precise in the region of the upper stop of the fork for forming the stacks, there is provided a fixedly arranged apparatus for feeding the lower cover board and the upper cover board for the stack. On the other side of the compartment for forming the stacks consisting of sheets there is provided a station for compressing and tying up the stacks. For conveying away the finished stack, out of the compartment into the pressing and tying apparatus, there is provided a carriage-like device, which is provided with vertically arranged side parts which form limiting bars which bear against the sides of the stack of sheets.

It is known that, for reasons of safety, in automatic, vertically arranged stacking apparatuses the cycle for conveying away the stack of sheets is longer than the cycle for conveying away the bundles in vertical, manually operated stacking apparatuses.

In the case of automatic stacking apparatuses, the lower cover board is placed on the fork when the latter has reached its upper position, to be precise after stopping the fork in its upper end position. Since the finished stack is also temporarily stopped in the downward movement in order to permit the upper cover board to be placed on, for reasons of safety there are in automatic stacking apparatuses additional waiting times of the order of 4 to 5 seconds per cycle. These delays do not occur in the case of stacking apparatuses to be loaded manually. Therefore, a time saving of the order of 20 to 30% is achieved for the operation of conveying away the stacks. In the manually loaded stacking apparatuses, the operator usually places the lower cover board on the fork already during its upward movement and the upper cover board is placed on the finished stack of sheets after setting the stack down on the roller conveyor. In other words, the operator uses one hand to place the upper cover board on the stack and the other hand to begin already moving this stack in the direction of the pressing and tying apparatus.

It is furthermore known that attempts have been made to increase the efficiency of rotary printing machines which are arranged upstream of the stacking apparatuses described. This increase in performance is measured in sheets per hour.

An increase in the performance of automatically operating, vertically arranged stacking apparatuses could be achieved by faster conveying away of the stacks of sheets or by increasing the prestacking stroke, which is defined by the upper position of the pivotable blade and the upper position of the fork. Due to safety periods which have to be observed, there are very confined limits within which the operation of conveying away the stack of sheets can be shortened. An increase in the prestacking stroke would result in an increase in the overall height of the stacking apparatus. If it is borne in mind that, in the case of the known stacking apparatuses for stacks having a stack height of 1 m, the stacking apparatuses can still be directly accessed and operated in order to carry out monitoring and maintenance work, it is obvious to a person skilled in the art that an increase in the overall height of the stacking apparatuses by, for example, 20 to 40 cm on account of an increase in the prestacking stroke is not acceptable in practice for various reasons. Stacking apparatuses of such increased overall height would require the use of steps, stools, stairs, handrails, balcony-like adjoining structures and safety equipment. These additional items require a larger installation area. This disadvantage is particularly serious if a series of stacking apparatuses are provided alongside one another.

It must also be taken into consideration that, with an increase in the prestacking stroke, the possibility of producing less high bundles is correspondingly restricted.

SUMMARY OF THE INVENTION

It is thus an object of the present invention to provide a vertical, automatically operating stacking apparatus of the said type with which a substantial increase in efficiency can be achieved without at the same time having to accept an increase in the structural dimensions, in particular in the overall height of the stacking apparatus.

A further object of the present invention is to provide a vertical, automatically operating stacking apparatus which, with a predetermined operating height for creating a given stack height, leaves open the possibility optionally of creating stacks of this given height or stacks of a considerably higher stack height.

The object according to the invention is achieved with a vertically arranged, automatically operating stacking apparatus for sheets in which there is provided in a holding frame an obliquely arranged roller conveyor and a roller conveyor arranged perpendicularly thereto, for receiving the stacks produced, as well as a compartment for creating the stacks, the compartment covering a section of the roller conveyor for receiving the stacks, with a compressing and tying station for the stacks created, which is arranged in a subregion of the roller conveyor next to the compartment for forming the stacks, with a carriage having pivotable side parts for displacing each stack from the compartment for creating the stacks to a compressing and tying station of the stacks, with an apparatus for placing a lower cover board on the fork for receiving the stack and an upper cover board on the upper side of the stack, with stopping means for the lower and upper fed cover boards, with a retractable blade, which can be pushed into the stream of sheets running to the stacking apparatus and can be withdrawn from this stream, and serves for completion of the formation of the stack to be respectively produced as well as for the initial forming of the prestack of the respectively following stack, with feelers for detecting the downward movement of the finished stack as well as with means for moving, controlling, stopping and driving the fork and the blade according to the cycle for creating and conveying away the stacks, a preliminary production of the prestack being performed in a prestacking zone and a completion of the stack being performed in the zone lying underneath the compartment, and the depositing of the finished stack being performed on the roller conveyor lying underneath, characterised in that a) the apparatus for feeding the lower cover board and the upper cover board is assigned devices for their movement back and forth in the vertical plane between a first position, which corresponds essentially to the upper position of the fork for the pushing-in of the lower boards, and a second position of the apparatus for feeding the upper boards, in which the pushing-in of the upper cover board onto the stack is performed, the second position of the apparatus for feeding the boards, that is to say the position for pushing in the upper cover board onto the stack, forming with respect to the first position of the board feeding device an interference stroke which is within the prestacking stroke of the stacking apparatus;

b) the end stop of the cover boards is assigned holding means which are arranged so as to be movable back and forth in the vertical plane between a lower position, which corresponds to the loading position of the lower cover board on the fork, and an upper position, which corresponds to the loading position of the upper cover board in the prestacking stroke, and c) the side parts of the displacing carriage for the finished stack are designed at their upper end, by means of interposed devices, such that they are retractable in the vertical direction between an extended displacing position for conveying the stack, which in a known way corresponds essentially to the loading position of the upper cover board, and a retracted position for the return movement of the carriage into the compartment for forming the stacks, the retracted position lying underneath the upper position of the fork.

Various advantages can be achieved with the proposed apparatus.

The proposed stacking apparatus requires a limited number of constructional elements, which have a low space requirement, are simple to produce and operate safely and reliably and neither impair nor restrict access to the stacking device, and no greater space requirement is necessary for setting up the stacking apparatus.

It is to be regarded as a further advantage of the proposed stacking apparatus that the technical teaching can also be applied to already existing stacking apparatuses without any constructional difficulties.

The possibility of being able to produce with one and the same stacking apparatus stacks of sheets of conventional height, taking into consideration the overall height of the stacking apparatus, and stacks of sheets of a greater stack height, allows a free choice of the desired stack height, as well as use of the stacking apparatus also downstream of high-performance rotary printing machines.

BRIEF DESCRIPTION OF THE DRAWINGS

Further features, advantages and details of the stacking apparatus according to the invention can be taken from the following description, with reference to the attached drawings. An embodiment of the vertical stacking apparatus according to the invention is schematically represented in the drawings, in which.

DESCRIPTION OF THE PREFERRED EMBODIMENTS

The vertical stacking apparatus according to the invention is identified overall by 1.

Figure 1:
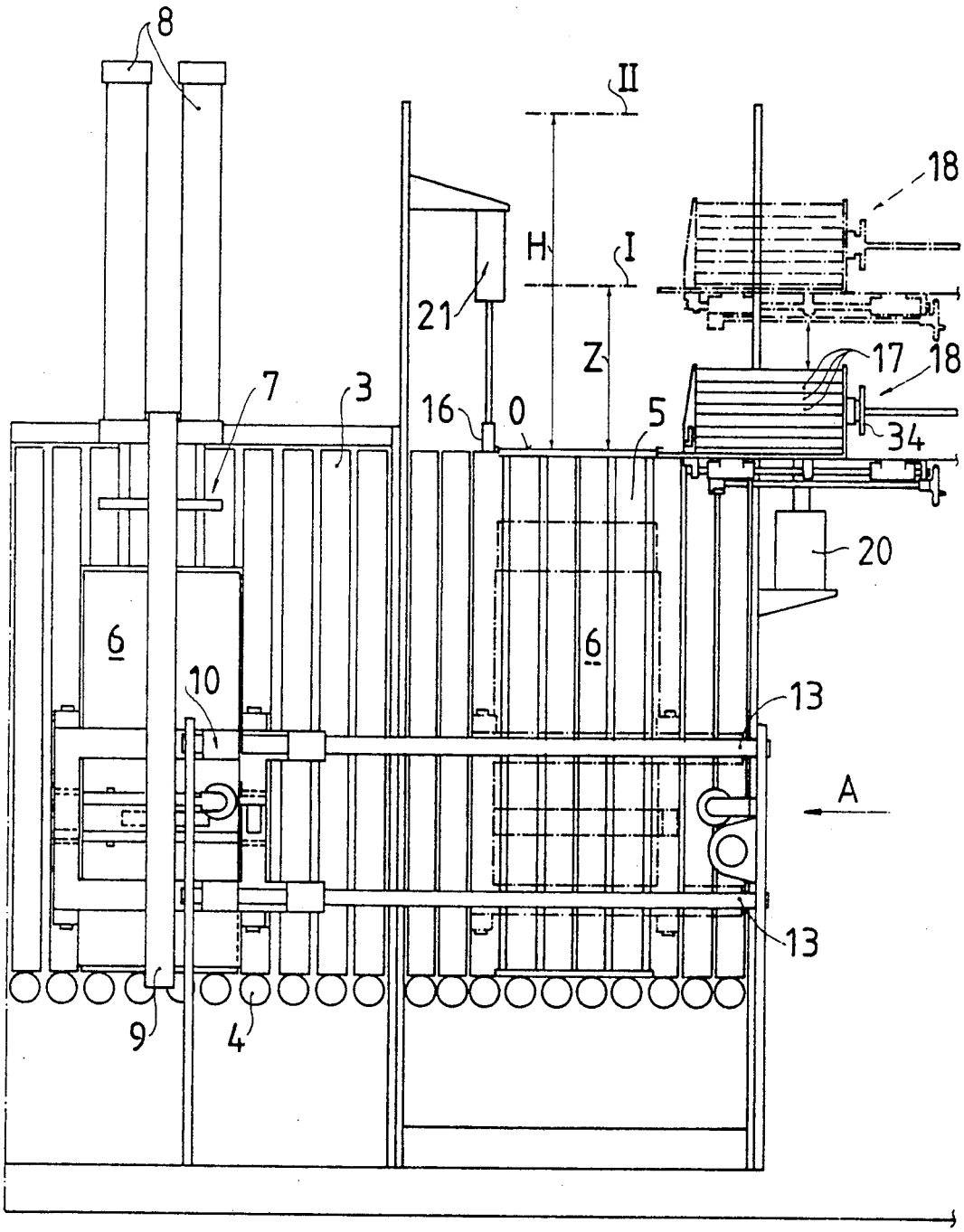
FIG. 1 shows a front view of the stacking apparatus according to the invention.
Figure 2:
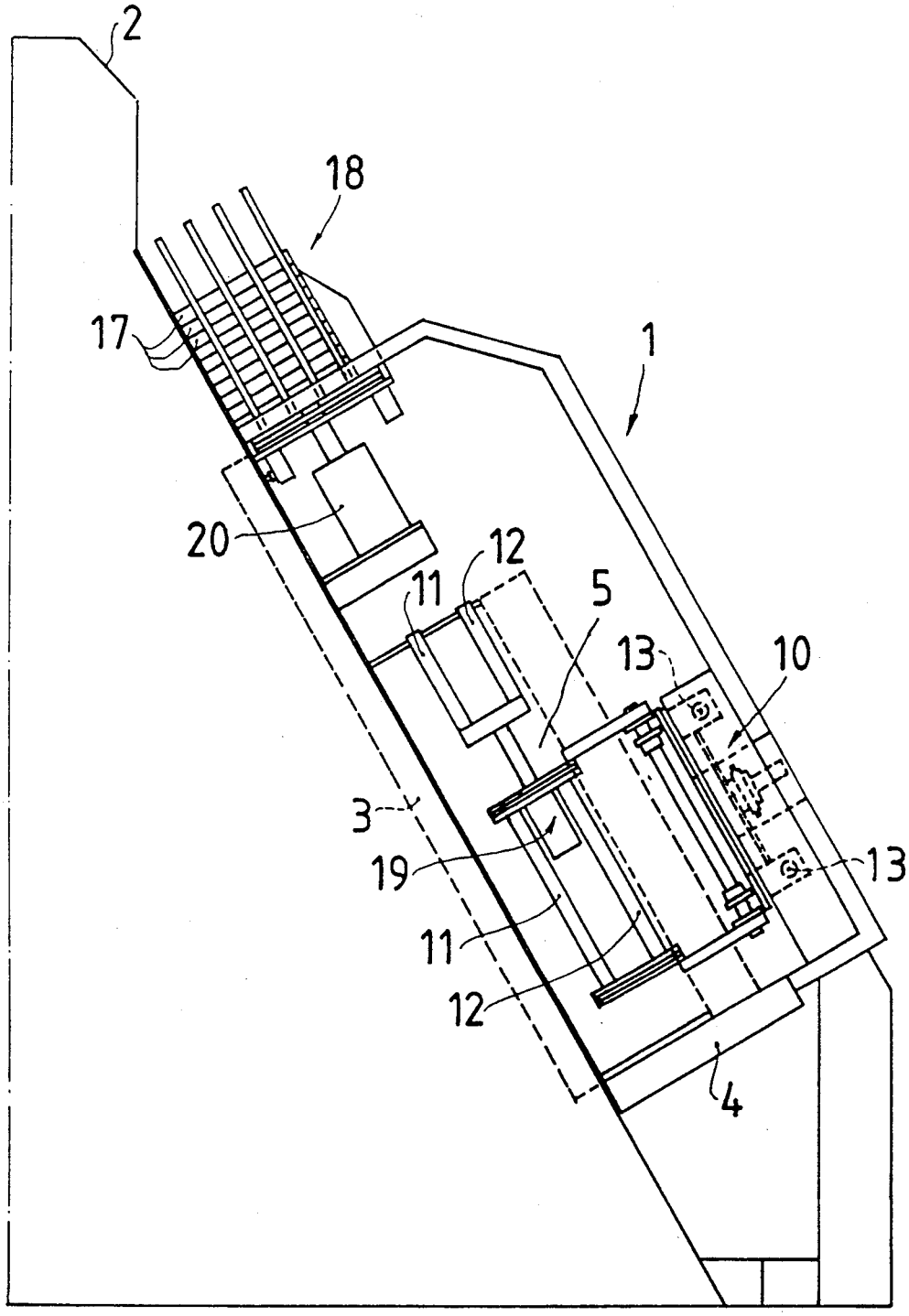
FIG. 2 shows a side view according to arrow A of the stacking apparatus according to FIG. 1.
Figure 3:
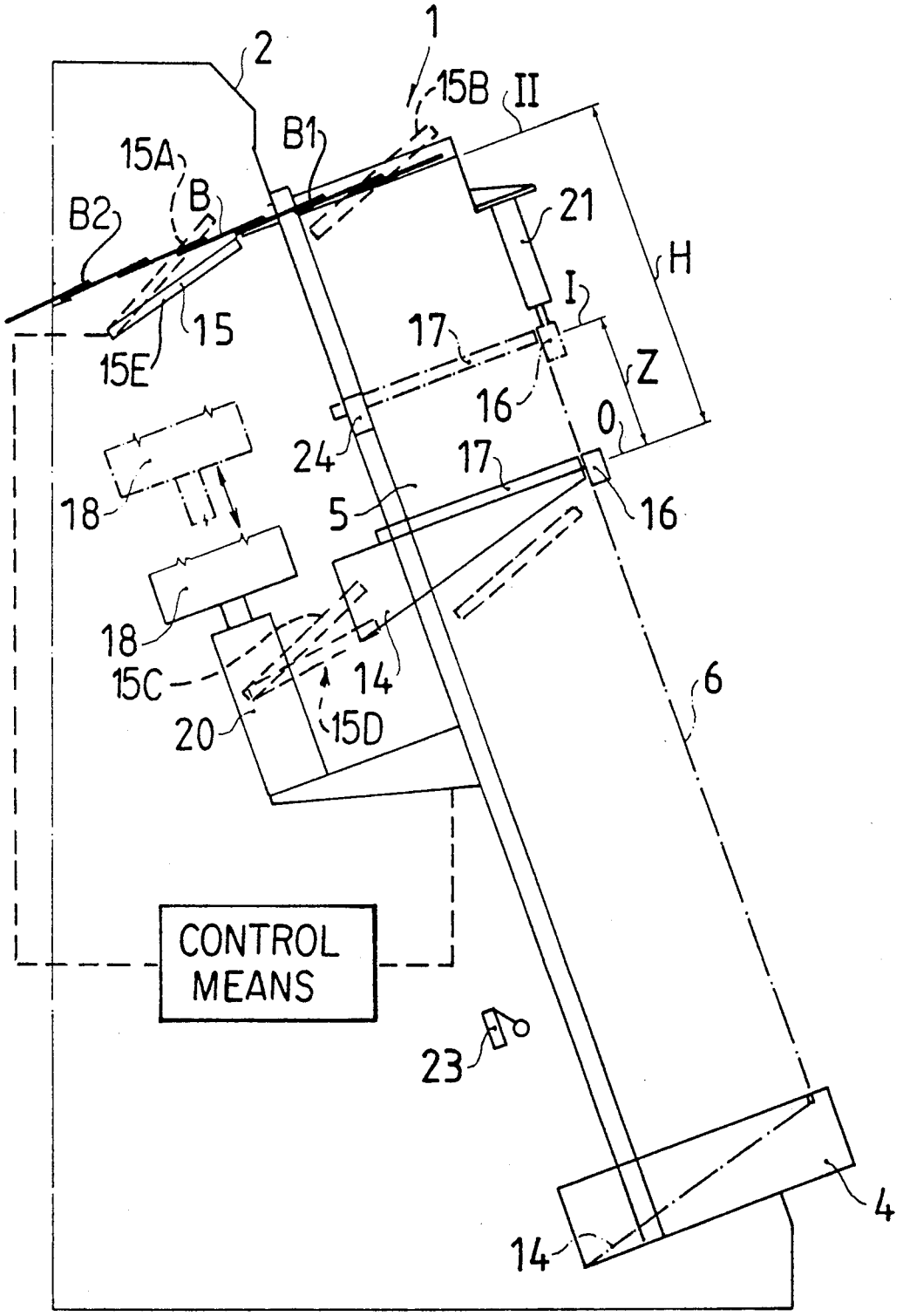
FIG. 3 shows a basic side view of the apparatus to show the interference stroke which can be achieved.

In the rack 2 of the stacking apparatus 1 there is provided an obliquely arranged roller conveyor 3, as well as a lower roller conveyor 4, which runs underneath a compartment 5 for forming a stack 6, and underneath a pressing and binding station 7. The pressing and binding station 7 is equipped with two pressure cylinders 8 and has a binding or tying device 9. A movable carriage for the finished stack 6 is identified overall by 10. The carriage 10 has, for example on each side, two bars 11 and 12, which extend over the entire height of the finished stack 6 located in the compartment 5. The carriage 10 is mounted displaceably on guides 13. The fork 14 can be moved between an upper position 0, which is represented by solid lines, and a lower position, which is represented by dashed lines. A blade for interrupting the sheet flow B is identified by 15. The blade 15 is represented in FIG. 3 in its upper loading waiting position. The height H, between the upper position II of the blade 15 and the position 0 of the fork in its upper position, forms a stacking stroke. A stop for the cover boards 17, which are accommodated in a board feeder 18, is indicated by 16. According to the invention, the lateral bars 11 and 12 are divided and are in effective connection with an interposed piston-cylinder unit 19. A further piston-cylinder unit 20 is assigned to the device 18 for feeding the boards. In the example represented, the stop 16 for the cover boards 17 is also assigned a piston-cylinder unit 21. A photocell 24 serves to sense the downwardly moving upper end of the finished stack. The photocell 24 is arranged to coincide with the upper end position I of the interference stroke Z, as explained in further detail below. The photocell 24 may be arranged fixedly or displaceably. Before the method of bundle forming/bundle removal according to the invention is described, a brief description is given of the operating sequence in known vertical stacking apparatuses with stationary board feeding device 18.

On the fork 14 there is already a cover board 17. The blade 15 with the prestack is lowered, until the prestack comes to lie on the fork 14 at a transferring position. The fork 14 begins the downward movement, during this movement the stack 6 is completed. The completion of the stack 6 is ended by the insertion of the blade 15, which has in the meantime been moved upwards, into the stream of sheets B and is detected for example by a switch 23. The operation for transporting away the bundle envisages a lowering of the stack, for example in 4 seconds, followed by the operation of placing the upper cover board 17 on top, for example in 3 seconds, then by a rapid lowering of the stack 6, for example in 1 second, and the depositing of the stack 6 on the roller conveyor 4. A displacing operation of the stack 6 into the compressing and tying station 7, 9 follows. This operation is performed, for example, within 4 seconds. Subsequently, a lifting movement of the fork 14 into the upper position 0 is carried out, for example within 7 seconds. There follows a placing of the lower cover board 17 onto the fork, for example in 3 seconds. Thus, in the example presented, such an operation for preparing and transporting away the stack 6 requires a time of about 22 seconds. The lower cover board and the upper cover board are always fed in the same position, that is to say with a stationary board feeding device 18.

According to the invention, the device 18 can be moved by means of a piston-cylinder unit 20, to be precise the board feed device can be moved into two different positions in height. In these positions there takes place the feeding of the upper cover board by the board feeder 18 in the position I, which corresponds to the uppermost position and is within the prestacking stroke H, while on the other hand the lower cover board is fed in a known way by using the board feeder 18 in the lower position 0. By maintaining an unchanged prestacking stroke H, there is the possibility of producing stacks of a stack height which extends from the lower roller conveyor 14 up to the level I and lies higher than the level 0 of the fork 14 when the latter is in its uppermost position and which forms with respect to the level 0 an interference stroke Z within the prestacking stroke H.

Owing to this reciprocating movement of the board feeder 18 for feeding the cover boards, it is necessary that the lateral bars 11 and 12 of the carriage 10 are designed at their upper end such that they can be retracted, in order not to strike against the board feeder 18 in its lowermost position. For this purpose, the lateral bars 11, 12 are designed to be of variable length, with piston-cylinder units 19 interposed. In a similar way, the end stop 16 of the cover boards 17 is assigned a piston-cylinder unit 21.

With the proposed type of construction there is carried out within the actual prestacking stroke H an interference stroke Z which serves both as actual prestacking stroke and as final stroke for the preceding stack and which permits the placing of the upper cover board on top. In this way, stacks of a greater overall height than with a conventional prestacking stroke H, without provision of an interference stroke, can be created with one and the same stacking device. With a stacking apparatus according to the present invention, it is possible with the same stacking height to produce the stack of sheets in a shorter time than is the case with other stacking apparatuses of the same design. It follows from this that the stacking device according to the invention can also be assigned to modern high-performance rotary printing machines. With the same height of the stack of sheets, the time for forming and transporting away the stack of sheets is about 10% less than previously conventional production times. In the case of the stacking apparatuses according to the invention, the movements, that is to say the lifting movements of the fork and of the blade, remain unchanged.

What is preserved in any event is the prerequisite for a single production cycle for creating and transporting away the stacks of sheets in an automatic manner, that is that the necessary time for transporting away the stack of sheets is less than the time for carrying out the prestacking stroke. For reasons of safety, the downwardly directed movement of the blade 15 is always stopped—with the assistance of a photocell or a similar device—at a safety distance of, for example, 3 cm above the uppermost position I of the board feeder 18 for feeding the cover boards. This precaution serves the purpose of avoiding a premature return movement of the blade 15, which would have the consequence of the sheets of the prestack dropping freely. Due to the differences in weight between the light stop 16 for the cover boards and the heavy board feeder 18, which may have a weight of 60 to 70 kg and, for this reason, is slower to move, independent piston-cylinder units 20, 21 are provided for the stop 16 and the board feeder 18.

In practice, it is possible by using the automatic stacking apparatus according to the present invention to produce stacks of the same overall height in a shorter time than is the case with conventional stacking apparatuses of the same height and with the same prestacking stroke, and a stationary board feeder 18, or by using a movable board feed apparatus 18 to create stacks of a greater overall height with times for the transporting away which are of the same order of magnitude as the times for transporting away the bundles of lower height. In both functional sequences of the vertically arranged, automatically operating stacking apparatus according to the invention, an orderly continuous transporting away of the stream of sheets, which may also be delivered at high speed from the rotary printing machine, is readily possible.

The design of the board feeder 18 for feeding the cover boards and the means for moving the board feeder 18, the stop for the cover boards and the upper end of the lateral limiting bars of the movable carriage may be chosen as desired.

It is also within the scope of the present invention to provide design modifications for the drive means and time-measuring means for the blade and the fork.

The known cycle (that is without an interference zone) for forming a sheet stack with the known so-called vertical stackers is disclosed, for example, in U.S. Pat. No. 3,969,993.

Figure 4:
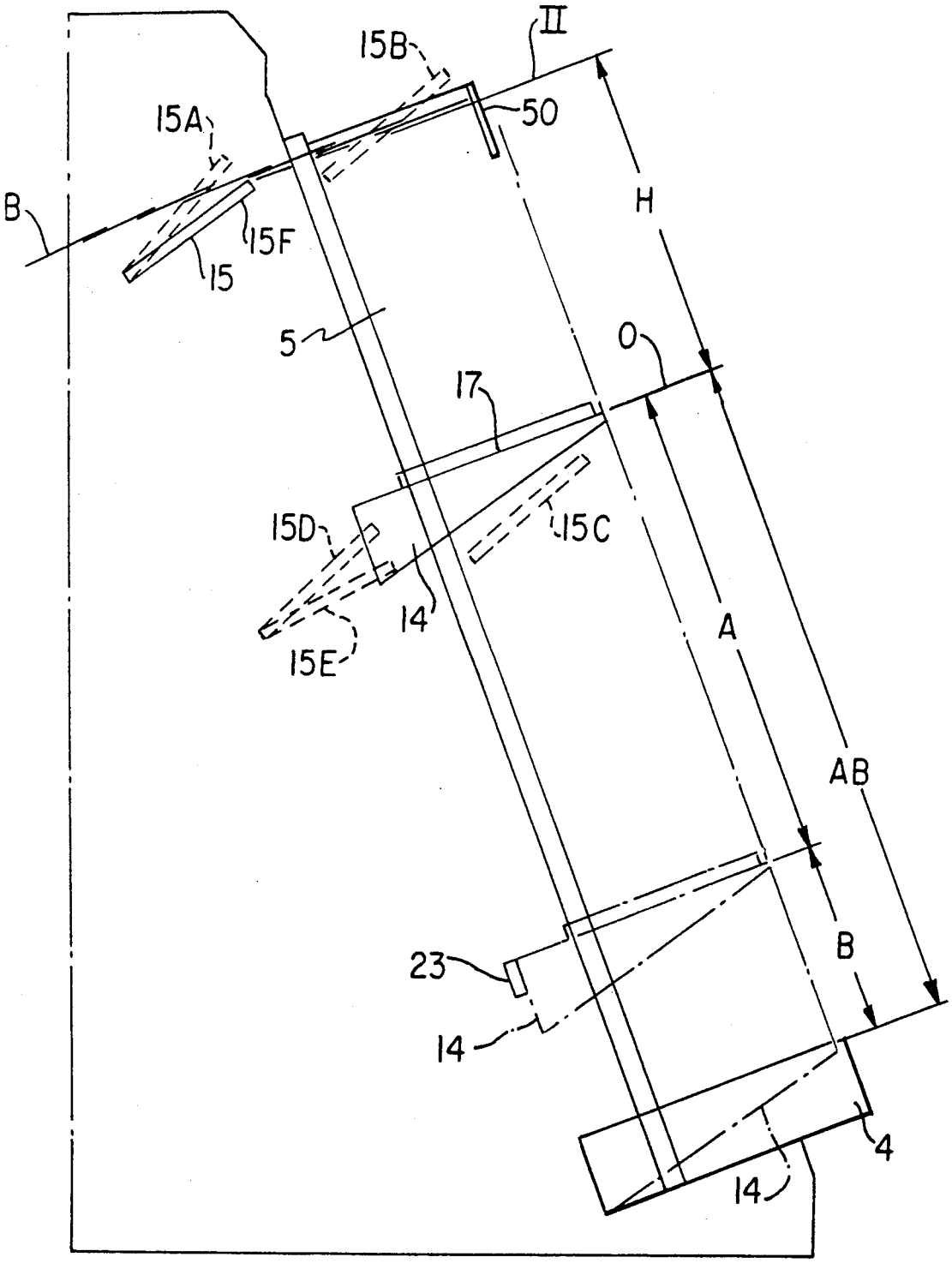
FIG. 4 PRIOR ART
FIG. 4 shows a basic side view of an automatic stacking apparatus in accordance with the prior art the interference stroke which can be achieved.

With respect to FIG. 3, the known cycle (illustrated by itself in FIG. 4) is as follows:

The sheet flow B is fed continuously. For the formation of each stack the blade 15 is tilted from the shown position 15E into the position 15A. In this manner, the sheets B2 downstream of the blade 15 fall onto the underlying previous stack and the sheets of upstream the blade 15 begin to form a new stack on the blade. The blade 15 is soon pushed into the position 15B in the compartment 5, that is in the upper position II, and the blade begins its downstroke towards the lower or transferring position O. The sheets B1 stacking onto the blade 15 during the stroke from the position II to the position O form the initial part of a new stack, that is a pre-stack, and the stroke from II to O is called prestacking stroke.

While the blade 15 carries out the pre-stroke, the fork 14 has already laid down a previous completed stack onto the lower roller conveyor 4 and an operator (as with stackers according to U.S. Pat. No. 3,969,993) or a carriage 10 (as in U.S. Pat. No. 4,772,169) pushes the stack from the compartment 5 into the pressing and binding station 7. Immediately after the stack is shifted away from the compartment 5, the fork 14 moves rapidly upwards and its reaches the position O earlier than the blade 15. When the blade 15 reaches the position O, it transfers the pre-stack lying on the blade 15 onto the fork 14 which soon begins its stroke downwards. The sheets which are now fed fall on the pre-stack onto the fork for the formation of a stack having the desired height or the desired number of sheets. In FIG. 3 is shown a microswitch 23 cooperating with the fork 14 for determining the desired stack height.

After transferring the pre-stack onto the fork 14, the blade 15 is withdrawn into the position 15C, then tilted into the position 15D and raised into the position 15E. In this position, the blade 15 is ready for being tilted again into the position 15A for interrupting the sheet stream and starting the formation of a new pre-stack.

The stacking stroke is the stroke for the completion of a stack by means of the fork, that is the stroke between the position O and the microswitch 23.

As concerns endboard feeder 18, in order to avoid spotting the sheets at the stack end sections, it is usual to put a rigid endboard at each stack end. Both endboards can be placed manually (U.S. Pat. No. 3,969,993) or by a stationary endboard feeder (U.S. Pat. No. 4,772,169).

According to the present invention, the upper end of a completed stack lies within the interference zone or stroke Z. When the blade 15 enters the interference zone Z, the previous completed stack has of course already been previously pushed away from the stack forming compartment 5.

I claim:

1. Apparatus for the vertical stacking of sheets comprising a holding frame;

an obliquely arranged roller conveyor and a lower roller conveyor arranged perpendicular to each other in the holding frame for receiving a stacks produced;

a compartment for creating the stacks, the compartment covering a section of each of the roller conveyors for receiving the stacks;

a compressing and tying station for compressing and tying the stacks created, the station being arranged next to the compartment for creating the stacks;

a carriage for displacing each stack from the compartment to the station, a fork movable within the compartment between first and second loading positions;

feeding means for placing a lower cover board on the fork for receiving a successive one of the stacks and for placing an upper cover board on an upper side of the successive stack;

stopping means for retaining position of the lower and upper cover boards with respect to the successive stack, a retractable blade which may be inserted into a path of a stream of sheets running to the compartment and may be withdrawn from the path;

feeler means for detecting a downward movement of a finished stack;

means for moving, controlling, stopping and driving the fork and blade according to a cycle for creating and conveying away the stacks, the cycle including a preliminary production of a pre-stack being performed in the pre-stacking zone and a completion of the stack being performed underneath the pre-stacking zone, said feeding means being movable back and forth in a plane parallel to the obliquely arranged conveyor and between a first loading position, which corresponds to an upper position of the fork at which one of the lower boards may be moved onto the fork, and a second loading position, at which one of the upper boards may be moved onto the upper side of the successive stack; so as to form with respect to the first position an interference stroke which is within a pre-stacking stroke;

the stopping means being movable back and forth in a vertical plane between a lower position, which corresponds to the first loading position of the lower cover board on the fork, and an upper position, which corresponds to the second loading position of the upper cover board in the pre-stacking stroke, and a displacing carriage being retractable between an extended displacing position for conveying the finished stack and a retracted position within the compartment, the extended displacing position corresponding to the second loading position of the upper cover board, the retracted position being reached from the extended displacing position by return movement of the carriage into the compartment at which a next successive stack may be formed, the retracted position lying underneath the upper position of the fork.

2. Apparatus for the vertical stacking of sheets according to claim 1, further comprising means for displacing back and forth the feeding means and the stopping means.

3. An apparatus for stacking of sheets, comprising:

a compartment;

means for feeding sheets into the compartment;

blade means for forming successive pre-stacks of sheets within a pre-stacking zone in the compartment, the blade means being displaceable within the pre-stacking zone in the compartment between a loading position and a transferring position, the blade means being further displaceable into the compartment to the loading position and displaceable out of the compartment from the transferring position;

fork means for forming a remainder of each of the pre-stacks in succession to form successive finished stacks one at a time by displacing from the transferring position to a discharging position each time a successive one of the pre-stacks is transferred to the fork means;

discharge means operative when the fork means reaches the discharging position for discharging each of the finished stacks in succession from the fork means to outside of the compartment;

transfer means for transferring each of the pre-stacks in succession to the fork means, the transfer means including means for displacing the blade means out of the compartment from the transferring position when the successive pre-stack is complete and for bringing the fork means from the discharging position to the transferring position before the successive pre-stack is complete but after discharge of a successive finished stack has been effected;

means for placing a cover board on the fork means when the fork means is in the loading position and for placing a cover board on an upper side of the successive finished stack; and control means for moving, driving and stopping of the blade means and fork means according to a cycle for creating and discharging the finished stacks in succession, the control means further commencing formation of a respective one of the successive pre-stacks within the compartment at the same time that an immediately preceding remainder of the stack extends into the pre-stacking zone at a location beneath where commencement of formation of the respective one of the successive pre-stacks takes place.

* * * * *